US005669246A

United States Patent [19]

Massardi

[11] Patent Number: 5,669,246

[45] Date of Patent: Sep. 23, 1997

[54] DEVICE FOR FEEDING A THREAD, PARTICULARLY AN ELASTIC THREAD, FOR KNITTING MACHINES, HOSIERY KNITTING MACHINES, OR THE LIKE

[76] Inventor: Lorenzo Massardi, Via della Chiesa, 98 - 25127, Brescia, Italy

[21] Appl. No.: 650,243

[22] Filed: May 20, 1996

[30] Foreign Application Priority Data

May 23, 1995 [IT] Italy ..... MI95A001053

[51] Int. Cl.[6] ..... D04B 15/48

[52] U.S. Cl. ..... 66/146; 242/128; 242/147 R

[58] Field of Search ..... 66/146; 242/128, 242/147 R, 416

[56] References Cited

U.S. PATENT DOCUMENTS

| | | | |
|---|---|---|---|
| 670,392 | 3/1901 | Ames | 66/146 X |
| 3,858,416 | 1/1975 | White et al. | 66/146 X |
| 4,687,151 | 8/1987 | Memminger et al. | 242/128 X |
| 4,934,627 | 6/1990 | MacNeil | 242/128 |

FOREIGN PATENT DOCUMENTS

| | | | |
|---|---|---|---|
| 1051145 | 10/1983 | U.S.S.R. | 66/146 |

*Primary Examiner*—John J. Calvert

*Attorney, Agent, or Firm*—Guido Modiano; Albert Josif; Daniel O'Bryne

[57] ABSTRACT

The thread feeding device has a supporting element for a spool of thread to be fed, and a variable-speed motor having a body connected to the supporting element and an output shaft connected to an arm that is rotatable about the axis of the spool with respect to the spool itself. The arm is provided, proximate to its end that is spaced from the spool axis, with a thread passage so as to perform, as a consequence of its own rotation, the gradual unwinding of the thread from the spool. The device also has an actuation and control element that drives the motor with a speed that can vary according to the tension required for the thread during feeding.

31 Claims, 2 Drawing Sheets

DEVICE FOR FEEDING A THREAD, PARTICULARLY AN ELASTIC THREAD, FOR KNITTING MACHINES, HOSIERY KNITTING MACHINES, OR THE LIKE

BACKGROUND OF THE INVENTION

The present invention relates to a device for feeding a thread, particularly an elastic thread, for knitting machines, hosiery knitting machines, or the like.

The increasing use of elastic threads in the production of hosiery items has brought about the need to feed the elastic thread to the hosiery knitting machine with a preset tension that is optionally variable according to the various steps for producing the hosiery item.

Thread feeders are currently used which substantially consist of a structure that supports, so that it can rotate freely about its own axis, a spool on which the thread to be fed is wound; the spool is turned about its own axis, so as to gradually unwind the thread, by means of a roller that makes contact with the lateral surface of the spool on which the thread is wound, said roller being actuated by a variable-speed motor. This device allows the length of thread unwound from the spool to be independent of the winding diameter of the thread on the spool, and the motor that drives the roller is actuated by an electronic actuation and control device, for example a microprocessor, which varies the rotation rate of the motor to vary the amount of thread that is dispensed and its tension according to the requirements of the various production steps of the machine.

However, such devices are not free from drawbacks.

Indeed, due to the fact that thread unwinding is achieved by turning the entire spool, which has a relatively large mass, about its axis, during sudden stops of the machine the spool continues to rotate, due to its inertia, along an arc of a rotation that causes an unwanted loosening of the thread, with the possible passage of the thread below the roller in contact with the spool, causing inevitable jamming of the thread feeder or breakage of the thread itself. Restoring the correct operation of the thread feeder therefore requires the intervention of an operator, with significant production losses.

Furthermore, with these thread feeders it becomes necessary to control both the actuation speed of the machine and the tightness of the knitting being produced, so as to adapt the feed of the thread to these parameters in order to achieve the correct tension of the thread during feeding.

SUMMARY OF THE INVENTION

A principal aim of the present invention is to solve the above problems by providing a device for feeding a thread, particularly an elastic thread, for knitting machines, hosiery knitting machines, or the like, which causes no problems during sudden stops in thread feeding.

Within the scope of this aim, an object of the invention is to provide a device that ensures high precision in thread feeding, with a preset tension, without requiring the control of parameters of the machine, such as for example the operating speed of the machine and the tightness of the knitting being produced.

Another object of the invention is to provide a feeder that is highly reliable in operation, significantly reducing operator interventions.

Another object of the invention is to provide a device that is structurally simple and can thus be produced with competitive costs.

This aim, these objects, and others which will become apparent hereinafter are achieved by a device for feeding a thread, particularly an elastic thread, for knitting machines, hosiery knitting machines, or the like, characterized in that it comprises a supporting element for a spool of thread to be fed and a variable-speed motor having a body connected to said supporting element and, by means of its output shaft, to an arm that is rotatable about the axis of said spool with respect to said spool and is provided, proximate to one of its ends that is spaced from said axis, with a thread passage for the gradual unwinding of the thread from said spool, an actuation and control element being provided which drives said motor with a speed that is variable according to the tension required for the thread during feeding.

BRIEF DESCRIPTION OF THE DRAWINGS

Further characteristics and advantages of the invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
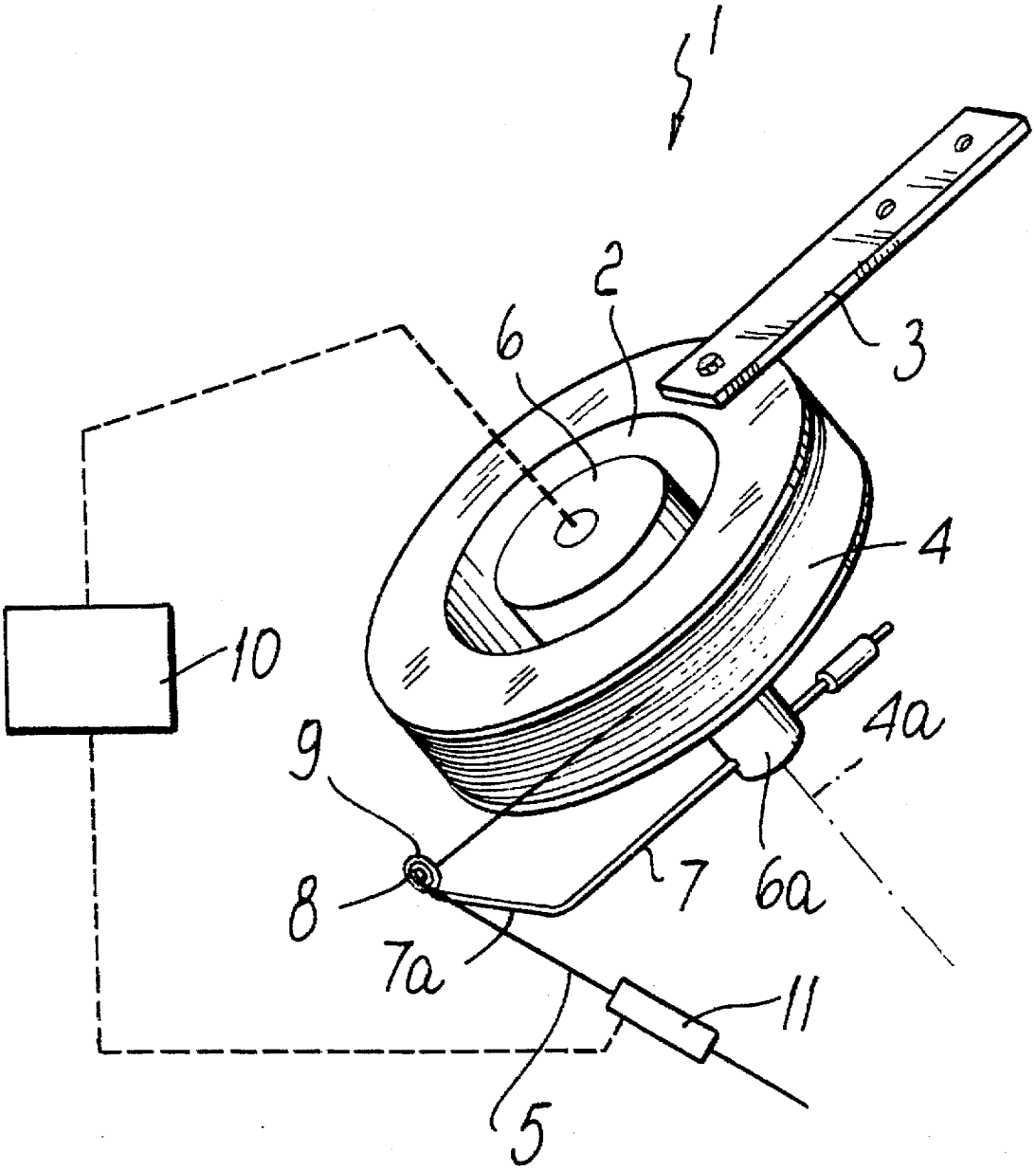
FIG. 1 is a schematic perspective view of the device according to the invention.
Figure 3:
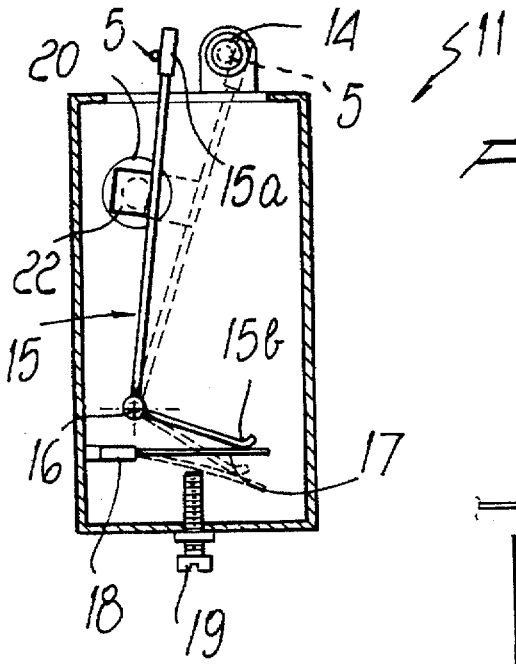
FIG. 3 is a schematic sectional view of FIG. 2, taken along the plane III—III.
Figure 2:
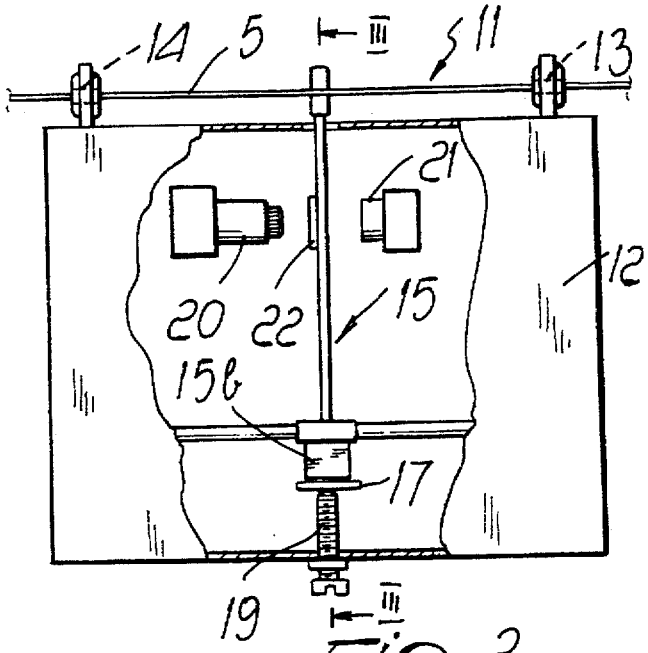
FIG. 2 is a schematic and partially sectional lateral elevation view of an element for sensing the tension of the thread.
Figure 4:
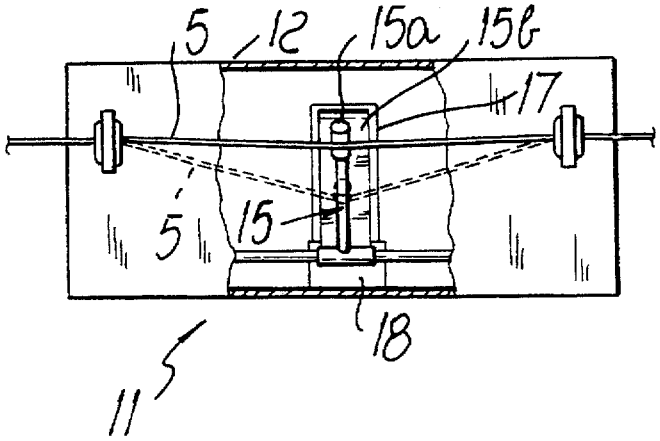
FIG. 4 is a schematic top plan view of the thread tension sensor.

With reference to the above figures, the device according to the invention, generally designated by the reference numeral 1, comprises a supporting element 2 that can be fixed to the supporting structure of the knitting machine or hosiery knitting machine, for example by means of a supporting bracket 3, and supports a spool 4 whereon the thread 5 to be fed to the machine is wound.

A variable-speed motor 6, preferably constituted by an electric step motor, is mounted on the supporting element and is connected, by means of its output shaft 6*a*, to an arm 7 which is rotatable about the axis 4*a* of the spool 4 with respect to said spool and is provided, proximate to one of its ends that is spaced from the axis 4*a*, with a passage 8 for the thread 5, so as to achieve the gradual unwinding of the thread 5 from the spool 4 as a consequence of the rotation of the arm 7 about the axis 4*a*.

Preferably, the motor 6 is fixed by means of its body to the supporting element 2 and is arranged so that its output shaft 6*a* is coaxial to the spool 4.

The arm 7, which has an extremely small mass, lies substantially at right angles to the axis 4*a* and ends with a folded end portion 7*a* whereat a ring 9 is connected; said ring is made of wearproof material, for example ceramic material, and forms the passage 8 for the thread 5.

As is clearly shown in FIG. 1, the spool 4 has advantageously, especially when thin elastic thread is unwound, a flat configuration. In this manner, upon unwinding, a thread length makes only a limited excursion on one side and the other of an intermediate tangential unwinding direction of the thread corresponding to the thread passage 8.

The device according to the invention furthermore comprises an actuation and control element 10 that drives the motor 6 with a variable speed, so as to obtain, for the thread 5, a tension corresponding to the tension required during feeding.

The device also comprises an element 11 that senses the tension of the thread 5 unwound from the spool 4; said sensor 11 is arranged between the arm 7 and the machine to be fed.

The actuation and control element 10 is preferably constituted by a programmable microprocessor, in which the tension required for the thread during feeding in the various production steps of the machine is set and stored beforehand.

The sensor 11 is connected in input to the actuation and control element 10 which, by comparing the tension of the thread 5 sensed by the sensor 11 and the preset tension, drives the motor 6 with a speed that is adapted to set the tension of the thread 5, during feeding, to the same value as the preset tension.

In practice, the actuation and control element 10 is connected to the sensor 11 with its input and to the motor 6 with its output.

The sensor 11 that senses the tension of the thread 5 is substantially composed of a supporting structure, constituted for example by a plate 12, to be connected to the supporting structure of the machine in a region located between the arm 7 and the thread guides with which the machine is equipped, said structure having at least two passages 13 and 14 for the thread 5 dispensed by the spool 4, said passages being conveniently covered with a wearproof material, for example a ceramic material.

A lever 15 is pivoted to the plate 12 and can oscillate about its fulcrum 16 on a plane that is substantially perpendicular to the path for the thread 5 formed by the passages 13 and 14.

More particularly, the lever 15 has a contact end 15*a*, conveniently covered with a wearproof material, for example a ceramic material, that is arranged along the path formed by the two passages 13 and 14 so as to make contact with the thread 5 to be controlled. The contact end 15*a*, by resting against the thread 5 along the path between the passages 13 and 14, diverts the path of the thread between said two passages 13 and 14.

The other end 15*b* of the lever 15 rests against an elastic element constituted by a flat spring 17 that acts on the lever 15 so as to cause its oscillation in the direction that increases the deflection imparted to the thread 5 by contact with the end 15*a*.

More particularly, the flat spring 17 is fixed, by means of one of its ends, to a block 18 that is rigidly coupled to the plate 12 and the connection to the lever 15 is achieved by simple resting or abutment.

Means for adjusting the flexural rigidity of the flat spring 17 act on said flat spring 17 and are conveniently constituted by a screw 19 that is connected to the plate 12 and constitutes a variable-position resting element for an intermediate region of the extension of the flat spring 17.

In practice, by acting on the adjustment screw 19 it is possible to vary, according to requirements, the elastic reaction of the flat spring 17 that is discharged onto the lever 15.

The lever 15 extends preferably, on opposite sides with respect to its fulcrum 16, along two mutually inclined directions.

The sensor 11 is furthermore equipped with means for sensing the oscillation of the lever 15 about its fulcrum, as a consequence of the engagement of the contact end 15*a* with the tensioned thread 5, contrasted by the flat spring 17.

Said sensing means can be constituted, in a per se known manner, by an optical sensor or by a magnetic sensor or by a capacitive sensor or by an inductive sensor or by a piezoelectric sensor or by load cells or other technically equivalent sensing means.

The accompanying drawings show an optical sensor substantially composed of a light beam projector 20 and of a photocell 21 that faces the projector 20. An intermediate portion of the lever 15 is provided with a flap or shutter 22 arranged between the projector 20 and the photocell 21.

In practice, the oscillation of the lever 15 about its fulcrum 16, as a consequence of the action applied by the thread 5 to the lever 15 and contrasted elastically by the flat spring 17, produces a variation in the amount of light received by the photocell 21. The photocell 21 thus emits a signal that is proportional to the oscillation of the lever 15 about its own fulcrum and is therefore proportional to the actual tension of the thread 5.

The photocell 21 is connected to one of the inputs of the actuation and control element 10, which thus controls the actual tension of the thread 5.

The operation of the device according to the invention is as follows.

The tension of the thread 5 during feeding is set in the actuation and control element 10, and it is possible to provide for different tension values according to the various production steps of the item to be formed.

At the beginning of the feeding of the thread 5, the actuation and control element 10 drives the motor 6 which, by turning the arm 7, gradually unwinds the thread 5 from the spool 4.

During the dispensing of the thread 5, the tension of said thread is checked constantly by the sensor 11 which, by means of the photocell 21 or other sensor means, sends to the actuation and control element 10 a signal that is proportional to the actual tension of the thread 5.

The actuation and control element 10 checks said actual tension value against the preset tension value, and if the sensed tension value does not match the preset tension value, changes the rotation rate of the motor 6, increasing or decreasing it to bring the value of the actual tension of the thread 5 to the preset value.

It should be noted that if the machine suddenly stops for any reason, the motor 6 is stopped, causing the immediate stop of the arm 7 which, by virtue of its very small mass, effectively avoids further unwinding of the thread 5.

In practice it has been observed that the device according to the invention fully achieves the intended aim, since it is capable of immediately stopping the dispensing of the thread as a consequence of sudden stops of the machine, effectively avoiding an excessive dispensing of thread and thus avoiding jammings when thread feeding resumes.

Another advantage is that it is possible to feed the machine with a thread that is subjected to a tension that corresponds to the required tension without requiring any sensing of the actuation speed of the machine or of the thickness of the knitting being formed.

The device thus conceived is susceptible of numerous modifications and variations, all of which are within the scope of the inventive concept; furthermore, all the details may be replaced with other technically equivalent elements.

In practice, the materials employed, as well as the dimensions, may be any according to the requirements and the state of the art.

What is claimed is:

1. Device for feeding thread for knitting machines and hosiery knitting machines comprising:

a supporting element;

a spool of thread to be fed, said spool defining an axis thereof and being fixedly connected to said supporting element;

a variable-speed motor having a body and an output shaft, said body being connected to said supporting element;

an arm having a first end thereof connected to said output shaft for rotating about the axis of said spool, said arm gradually unwinding the thread from said spool;

a thread passage provided at a second free end of said arm for guiding the unwound thread;

an actuation and control element for controllably driving said motor with a speed that is variable according to a tension required for the thread during feeding;

a thread tension sensor operatively connected to said actuation and control element, said tension sensor being arranged between said arm and the knitting machine along a thread feeding direction for sensing a tension degree of the thread being fed to the knitting machine, and wherein said tension sensor comprises:

at least two passages forming a thread path for the thread to be controlled;

an oscillatable lever, said lever having a contact end arranged along the path formed by said two passages, said contact end making contact with the thread for performing a deflection of the thread path between said two passages; and oscillation sensing means for sensing the oscillation of said lever as a consequence of the tension degree of the thread engaged by said contact.

2. Device according to claim 1, wherein said actuation and control element is constituted by a programmable microprocessor.

3. Device according to claim 1, wherein said tension sensor is connected in input to said actuation and control element for providing thereat a sensed thread tension, said actuation and control element performing a comparison between the sensed thread tension and a preset tension value and actuating said motor with a speed adapted to set said thread tension, during feeding, to the preset tension value.

4. Device according to claim 1, wherein said motor is constituted by an electric step motor.

5. Device according to claim 1, wherein said motor is mounted on said supporting element with said output shaft being arranged coaxial to said spool.

6. Device according to claim 1, wherein said arm lies transversely to said output shaft of the motor.

7. Device according to claim 1, wherein said thread passage is formed by a ring made of wearproof material, said ring being connected to said second end of the arm.

8. Device according to claim 3, wherein said thread tension sensor comprises: a supporting structure on which said at least two passages for the thread are formed, said lever being pivoted, at an intermediate portion thereof, to said supporting structure for oscillating transversely to said thread path; and an elastic element constituted by a flat spring, the lever having a further end thereof, opposite to said thread contact end, which makes contact with said flat spring, said flat spring acting on said lever for causing an oscillation thereof that increases said thread path deflection.

9. Device according to claim 8, wherein said lever extends, on opposite sides with respect to the pivoted intermediate region thereof, along two mutually inclined directions.

10. Device according to claim 8, wherein said thread contact end of the lever is covered with wearproof material.

11. Device according to claim 8, wherein said lever is oscillatable on a plane that is substantially perpendicular to said thread path.

12. Device according to claim 8, wherein said flat spring is fixed to said supporting structure at an end thereof, adjusting means being further provided at said supporting structure for adjusting flexural rigidity of said flat spring.

13. Device according to claim 12, wherein said adjusting means includes an adjustable-position support, said flat spring resting with an intermediate region thereof on said adjustable position support.

14. Device according to claim 8, wherein said oscillation sensing means comprises a sensor being any of an optical sensor, a capacitive sensor, an inductive sensor a magnetic sensor, a piezoelectric sensor, or at least one load cell connected to said lever, for sensing the position of said lever during its oscillation.

15. Device according to claim 14, wherein said optical sensor comprises a light beam projector and a photocell facing said projector, said photocell and projector being mounted on said supporting structure on opposite sides with respect to said lever, said lever being provided with any of a flap and a shutter for blocking a light beam of the projector to an extent being proportional to the oscillation of said lever, said photocell being connected in the input to said actuation and control element.

16. Device for feeding an elastic thread for knitting machines and hosiery knitting machines comprising:

a supporting element;

a spool of thread to be fed, said spool defining an axis thereof and being fixedly connected to said supporting element;

a variable-speed motor having a body and an output shaft, said body being connected to said supporting element;

a small mass arm having a first end thereof connected to said output shaft for rotating about the axis of said spool, said arm gradually unwinding the thread from said spool along a direction tangential to the spool;

a thread passage provided at a second free end of said arm for guiding the thread from said tangential direction to a thread feeding direction, said feeding direction intersecting the axis of the spool;

a thread tension sensor arranged between said arm and the knitting machine along said thread feeding direction for sensing tension of the thread being fed to the knitting machine; and an actuation and control element for controllably driving said motor with a speed that is variable according to a tension required for the thread during feeding, said tension sensor being operatively connected to said actuation and control element.

17. Device according to claim 16, wherein said actuation and control element is constituted by a programmable microprocessor.

18. Device according to claim 16, wherein said tension sensor is connected in input to said actuation and control element for providing thereat a sensed thread tension, said actuation and control element performing a comparison between the sensed thread tension and a preset tension value and actuating said motor with a speed adapted to set said thread tension, during feeding, to the preset tension value.

19. Device according to claim 16, wherein said motor is constituted by an electric step motor.

20. Device according to claim 16, wherein said motor is mounted on said supporting element with said output shaft being arranged coaxial to said spool.

21. Device according to claim 16, wherein said arm lies transversely to said output shaft of the motor.

22. Device according to claim 16, wherein said thread passage is formed by a ring made of wearproof material, said ring being connected to said second end of the arm.

23. Device according to claim 16, wherein said thread tension sensor comprises:

a supporting structure;

at least two passages formed on said supporting structure for providing a thread path for the thread to be controlled;

an oscillatable lever pivoted, at an intermediate portion thereof, to said supporting structure for oscillating transversely to said thread path, said lever having a first contact end arranged along the path formed by said two passages and a second opposite end, said first contact end making contact with the thread for performing a deflection of the thread path between said two passages;

an elastic element constituted by a flat spring, said second end of the lever making contact with said flat spring, said flat spring acting on said lever for causing an oscillation thereof that increases said thread path deflection; and oscillation sensing means for sensing the oscillation of said lever as a consequence of a tension degree of the thread engaged by said contact.

24. Device according to claim 23, wherein said lever extends, on opposite sides with respect to the pivoted intermediate region thereof, along two mutually inclined directions.

25. Device according to claim 23, wherein said thread contact end of the lever is covered with wearproof material.

26. Device according to claim 23, wherein said lever is oscillatable on a plane that is substantially perpendicular to said thread path.

27. Device according to claim 23, wherein said flat spring is fixed to said supporting structure at an end thereof, adjusting means being further provided at said supporting structure for adjusting flexural rigidity of said flat spring.

28. Device according to claim 27, wherein said adjusting means includes an adjustable-position support, said flat spring resting with an intermediate region thereof on said adjustable position support.

29. Device according to claim 23, wherein said oscillation sensing means comprises a sensor being any of an optical sensor, a capacitive sensor, an inductive sensor a magnetic sensor, a piezoelectric sensor, or at least one load cell connected to said lever, for sensing the position of said lever during its oscillation.

30. Device according to claim 29, wherein said optical sensor comprises a light beam projector and a photocell facing said projector, said photocell and projector being mounted on said supporting structure on opposite sides with respect to said lever, said lever being provided with any of a flap and a shutter for blocking a light beam of the projector to an extent being proportional to the oscillation of said lever, said photocell being connected in the input to said actuation and control element.

31. Device according to claim 16, wherein said spool has a flat configuration so that upon unwinding, a thread length makes only a limited excursion on one side and the other of an intermediate tangential unwinding direction of the thread corresponding to the thread passage.

* * * * *